US005918876A

United States Patent [19]

Maruyama et al.

[11] Patent Number: 5,918,876

[45] Date of Patent: Jul. 6, 1999

[54] SHEET CONVEYING APPARATUS

[75] Inventors: Hiroyoshi Maruyama; Masahiko Yashiro, both of Yokohama, Japan

[73] Assignee: Canon Kabushiki Kaisha, Tokyo, Japan

[21] Appl. No.: 08/966,198

[22] Filed: Nov. 7, 1997

Related U.S. Application Data

[63] Continuation of application No. 08/352,589, Dec. 9, 1994, abandoned.

[30] Foreign Application Priority Data

| | | | |
|---|---|---|---|
| Dec. 17, 1993 | [JP] | Japan | 5-318475 |
| Nov. 10, 1994 | [JP] | Japan | 6-276268 |
| Nov. 10, 1994 | [JP] | Japan | 6-276548 |

[51] Int. Cl.[6] ..... B65H 7/08

[52] U.S. Cl. ..... 271/228; 271/261; 271/274

[58] Field of Search ..... 271/227, 228, 271/273, 274, 261

[56] References Cited

U.S. PATENT DOCUMENTS

| | | | |
|---|---|---|---|
| 4,621,801 | 11/1986 | Sanchez | 271/251 |
| 4,939,676 | 7/1990 | Worsley et al. | 271/258.01 X |
| 4,995,601 | 2/1991 | Ohashi et al. | 271/127 |
| 5,090,680 | 2/1992 | Yashiro | 271/186 |
| 5,090,683 | 2/1992 | Kamath et al. | 271/227 |
| 5,140,166 | 8/1992 | Gerlier | 271/227 X |
| 5,156,391 | 10/1992 | Roller | 271/227 |

FOREIGN PATENT DOCUMENTS

| | | | |
|---|---|---|---|
| 0300095 | 1/1989 | European Pat. Off. . | |
| 300095 | 5/1989 | European Pat. Off. . | |
| 0485167 | 5/1992 | European Pat. Off. . | |
| 0536885 | 4/1993 | European Pat. Off. . | |
| 58-078937 | 5/1983 | Japan . | |
| 58-78937 | 5/1983 | Japan . | |
| 63-82255 | 4/1988 | Japan | 271/228 |
| 2-008133 | 1/1990 | Japan . | |
| 2-8133 | 1/1990 | Japan . | |
| 3-211147 | 9/1991 | Japan . | |
| 4-173643 | 6/1992 | Japan | 271/228 |
| 4-277151 | 10/1992 | Japan . | |
| 4-327445 | 11/1992 | Japan . | |
| 4-327445 | 3/1993 | Japan . | |

*Primary Examiner*—F. J. Bartuska

*Attorney, Agent, or Firm*—Fitzpatrick, Cella, Harper & Scinto

[57] ABSTRACT

The present invention relates to a sheet conveying apparatus with a pair convey rollers arranged upstream of a registration mechanism for correcting a skew-feed of a sheet in a sheet conveying direction that can be abutted against or separated from each other, or can be shifted in accordance with a length of the sheet in the sheet conveying direction. As the result, when the skew-feed of the sheet is corrected by the registration mechanism, a trailing end of the sheet is not restrained.

22 Claims, 13 Drawing Sheets

SHEET CONVEYING APPARATUS

This application is a continuation of application Ser. No. 08/352,589, filed Dec. 9, 1994, now abandoned.

BACKGROUND OF THE INVENTION

1. Field of the Invention

The present invention relates to a sheet conveying apparatus used with an image forming apparatus or image reading apparatus such as a copying machine, a scanner, a printer and the like, and more particularly, it relates to a sheet conveying apparatus wherein registration of sheet is effected at an upstream side of an image forming portion or an image reading portion.

2. Related Background Art

Conventionally, in image forming or image reading apparatuses such as copying machines, scanners, printers and the like, a registration device for determining posture and position of a sheet is arranged immediately in front of an image forming portion or an image reading portion. As such registration devices, for example, there has been proposed a registration device of loop registration type wherein a tip end of a sheet is abutted against a nip between a pair of stopped rollers to form a loop in the sheet, so that the tip end of the sheet is aligned with the nip, thereby correcting skew-feed of the sheet, and a registration device of shutter registration type wherein a shutter member for stopping a tip end of a sheet is retractably arranged in a sheet conveying path. After the tip end of the sheet is abutted against the shutter member to correct skew-feed of the sheet, the shutter member is retracted from the sheet conveying path.

However, recently, as such image forming or image reading apparatuses have been changed into digital design, a distance between sheets (referred to as "sheet interval" hereinafter) has been shortened so that a large number of sheets can be treated within a short time period, thereby increasing substantial image forming speed without increasing a process speed for image formation.

For example, in conventional digital copying machines, when a copying operation is performed continuously, since an optical system for exposing an original must be reciprocally shifted by times corresponding to the number of copies, the sheet interval used in an image information copying operation is necessarily determined. However, when the original is digitally read and the image is digitally formed, after the original was read once, the image information is electrically coded to be stored in a memory. In the image formation, the image information is read out from the memory, and a latent image corresponding to the image information is formed on a photosensitive member disposed in the image forming portion by using an exposure device including a laser beam or an LED array. Thus, even when a plurality of copies are obtained, mechanical movement of the optical system and the like can be eliminated.

Accordingly, the time period for effecting the registration of the sheet is one of important factors for determining the sheet interval. In order to reduce the registration time period, there has been proposed an active registration method for correcting the skew-feed of the sheet while conveying the sheet. In this method, two sensors are arranged in a sheet conveying path and disposed in a plane perpendicular to the sheet conveying path, so that a tip end of the sheet moving in the sheet conveying path is detected by the sensors, respectively, to determine inclination of the sheet on the basis of signals from the sensors, and the skew-feed of the sheet is corrected by controlling sheet convey speeds of skew-feed correction rollers (referred to as "regist rollers" hereinafter) arranged in a plane perpendicular to the sheet conveying path and drive independently. According to this method, since the skew-feed of the sheet can be corrected while conveying the sheet without stopping the sheet temporarily, the sheet interval can be reduced in comparison with other methods.

However, in the above-mentioned conventional example, if a size of the sheet to be conveyed is not constant, and particularly, if a long-sized sheet is conveyed, the correction of the skew-feed of the sheet must be effected by the regist rollers under a condition that a trailing end of the sheet is pinched between convey rollers disposed at an upstream side of the regist rollers in the sheet conveying direction. That is to say, in the above-mentioned active registration method, although a slower side (succeeding side) of the sheet is advanced or a faster side (preceding side) of the sheet is delayed by means of the regist rollers, in both cases, since the entire sheet must be rotated, if the trailing end of the sheet is pinched between the convey rollers, it will be hard to rotate the sheet by a desired amount, with the result that it is very difficult to correct the skew-feed of the sheet with high accuracy.

In order to eliminate the above drawback, there has been proposed a method wherein a loop is formed in the sheet in front of the regist rollers and the rotational movement of the sheet generated in the skew-feed correction is absorbed by distorting the loop. However, in this method, since the loop is released as soon as the trailing end of the sheet leaves the convey rollers, if the sheet interval is small, there is a danger of the collision of the trailing end of the sheet against a tip end of a next sheet. Thus, a certain amount of sheet interval or more must be maintained.

SUMMARY OF THE INVENTION

The present invention intends to eliminate the above-mentioned conventional drawbacks, and has an object to provide a sheet conveying apparatus which can continuously convey sheets having various sizes with a minimum sheet interval and can effect registration of sheet with high accuracy.

Incidentally, when a sheet conveying apparatus is used for a long time, it is supposed that there arises a problem that the rollers are gradually worn to gradually reduce outer diameters of the rollers, thereby worsening the desired convey speeds of the rollers, or paper powder and/or toner is trapped between the rollers to reduce friction forces of surfaces of the rollers, thereby worsening the desired pinching force of the nip between the rollers, and, thus, worsening the desired convey speeds of the rollers.

Accordingly, the present invention also aims to eliminate the above problem, and another object of the present invention is to provide a sheet conveying apparatus wherein, even after the apparatus is used for a long time or used repeatedly, registration of a sheet can be effected with high accuracy regardless of the frequency of use of the apparatus.

In order to achieve the above objects, an image forming apparatus according to the present invention comprises a registration means disposed at an upstream side of an image forming portion or an image reading portion in a sheet conveying direction and adapted to correct skew-feed of a sheet, a sheet convey means disposed at an upstream side of the registration means in the sheet conveying direction and adapted to be abutted against each other or separated from each other, a sheet length detection means disposed at an upstream side of the sheet convey means in the sheet conveying direction, and a sheet skew amount detection means disposed at a downstream side of the registration means in the sheet conveying direction. The sheet convey means is initially in a separated condition, and is changed into an abutted condition when a length of the sheet (in the sheet conveying direction) detected by the sheet length detection means is greater than a convey distance between the sheet convey means and the registration means and is smaller than a convey distance between the sheet convey means and the sheet skew amount detection means.

Since the sheet convey means disposed at the upstream side of the registration means (for correcting the skew-feed of the sheet while conveying the sheet) in the sheet conveying direction is abutted against each other or separated from each other in accordance with the length of the sheet, the sheets having various sizes can be continuously conveyed with the minimum sheet interval and the skew-feeds of the sheets can be continuously corrected with high accuracy.

A sheet conveying apparatus according to the present invention comprises a first skew amount detection means for detecting a skew amount of a sheet, a registration means for correcting skew-feed of the sheet, a second skew amount detection means for detecting a skew amount of the sheet the skew-feed of which was corrected by the registration means, and a control means for controlling the registration means on the basis of the skew amount of the sheet detected by the first skew amount detection means and the skew amount of the sheet previously detected by the second skew amount detection means.

DETAILED DESCRIPTION OF THE PREFERRED EMBODIMENTS (First Embodiment)

Figure 1:
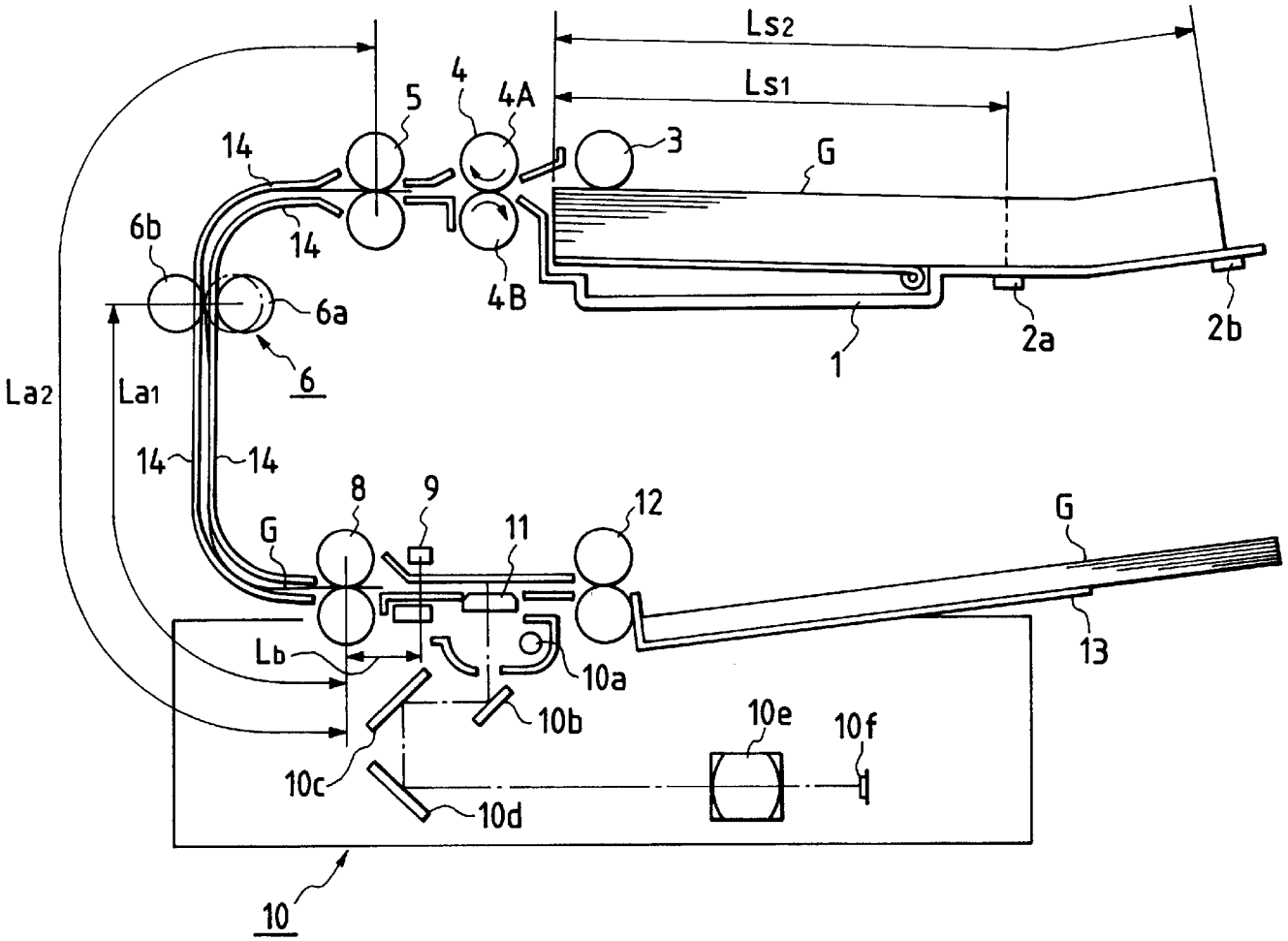
FIG. 1 is a schematic sectional view of a sheet conveying apparatus according to a first embodiment of the present invention applied to an original image reading apparatus.
Figure 2A:
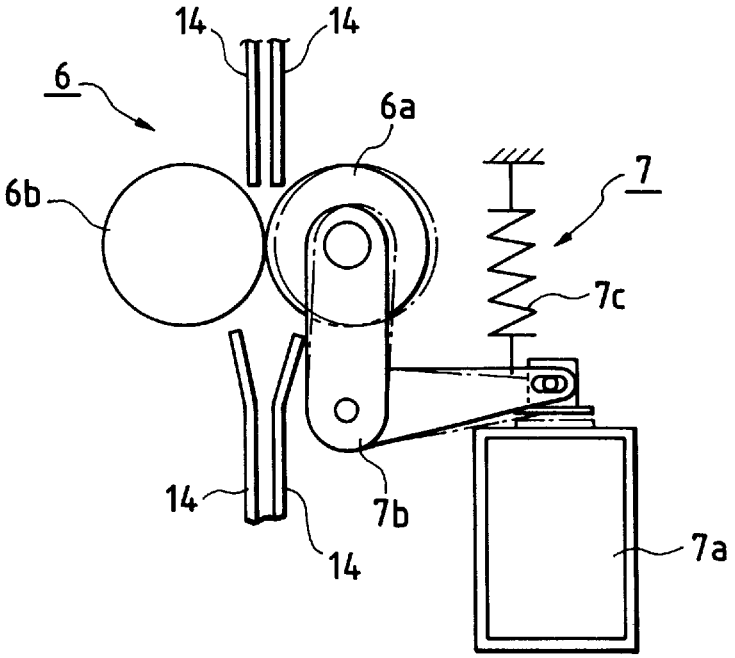
FIGS. 2A and 2B are sectional views showing an abutting and separating mechanism for abutting a pair of convey rollers of the apparatus of FIG. 1 against each other or separating the convey rollers from each other.
Figure 2B:
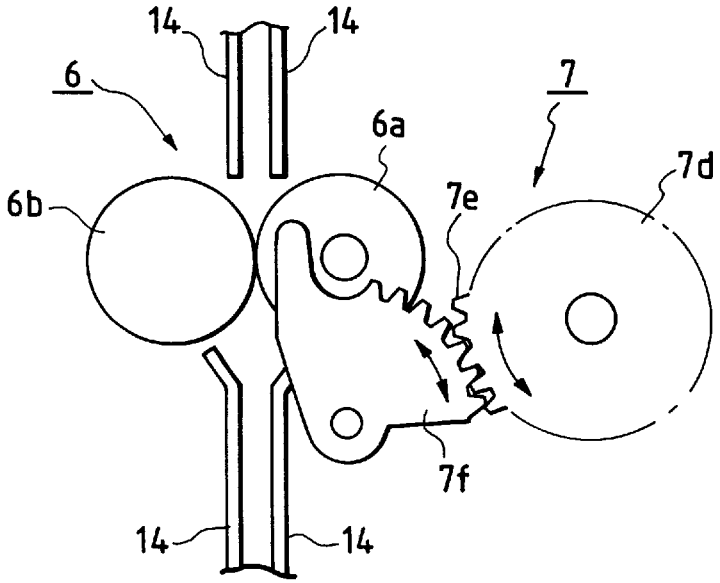
Figure 3:
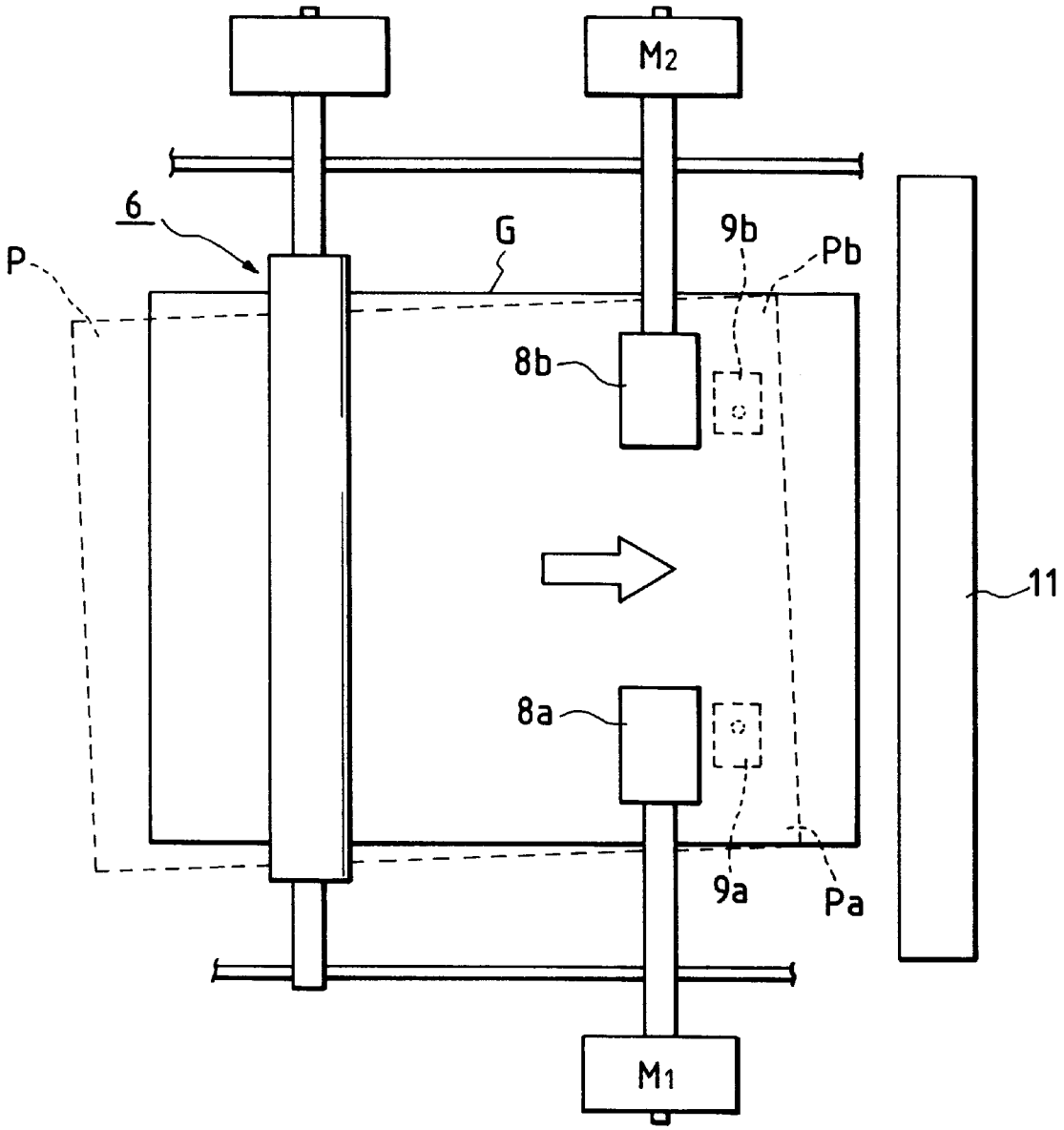
FIG. 3 is a plan view of an original skew correction portion of the apparatus of FIG. 1.

Now, a sheet conveying apparatus according to a first embodiment of the present invention which is applied to an original image reading apparatus will be concretely explained with reference to the accompanying drawings. FIG. 1 is a schematic sectional view of a sheet conveying apparatus according to a first embodiment of the present invention applied to an original image reading apparatus, FIGS. 2A and 2B are sectional views showing an abutting and separating mechanism for abutting a pair of convey rollers of the apparatus of FIG. 1 against each other or separating the convey rollers from each other, and FIG. 3 is a plan view of an original skew correction portion of the apparatus of FIG. 1.

In FIG. 1, a plurality of originals G are rested on an original stacking plate 1 with imaged surfaces thereof facing upwardly. Sensors (sheet length detection means) 2*a*, 2*b* serve to detect lengths $Ls_1$, $Ls_2$ (in an original conveying direction) of the originals G rested on the original stacking plate 1, respectively ($Ls_1<Ls_2$). A pick-up roller 3 has an outer peripheral surface coated by rubber having relatively high friction of coefficient and serves to feed out the original(s) G from the original stacking plate 1. A pair of separation rollers 4 comprises an upper roller 4A and a lower roller 4B which are both rotated in an anti-clockwise direction, thereby separating the originals G fed by the pick-up roller 3 one by one.

A first pair of convey rollers 5 and a second pair of separable convey rollers 6 are provided as a sheet convey means. As shown in FIGS. 2A and 2B, a roller 6*a* of the roller pair 6 can be abutted against or separated from the other roller 6*b* by means of an abutting and separating mechanism 7. In the illustrated embodiment, as shown in FIG. 2A, the abutting and separating mechanism 7 comprises a solenoid 7*a* which is electrically turned ON/OFF, an arm 7*b* for connecting the solenoid 7*a* to the roller 6*a*, and a spring 7*c* for urging the roller 6*a* against the roller 6*b*. Incidentally, in an initial condition, the solenoid 7*a* is being energized (ON condition) to separate the roller 6*a* from the roller 6*b*. When the solenoid 7*a* is disenergized, the roller 6*a* is abutted against the roller 6*b* by a biasing force of the spring 7*c*.

Further, in FIG. 1, there is provided a registration means 8 for correcting skew-feed of the original G. As shown in FIG. 3, the registration means 8 comprises two sets of rollers (convey means or rotary members) 8*a*, 8*b* arranged along a common line transverse to an original conveying direction and driven independently. That is to say, the skew-feed of the original is corrected by increasing or decreasing rotational speed of one set of rollers in accordance with a skew amount of the original so that the convey speed of one set is differentiated from the convey speed of the other set. Incidentally, in the illustrated embodiment, the skew-feed of the original is corrected by decreasing the rotational speed of the paired rollers in one set (regarding a preceding side of the original) in accordance with the skew amount of the original.

Further, there is also provided a sheet skew amount detection means 9. As shown in FIG. 3, the sheet skew amount detection means 9 comprises two sensors 9*a*, 9*b* of light permeable type arranged along a common line transverse to the original conveying direction and disposed in the original convey path. The skew-feed of the original is corrected by controlling respective drive motors $M_1$, $M_2$ for the pairs of regist rollers 8*a*, 8*b* by means of a control means (not shown) on the basis of the skew amounts of the original detected by the sensors 9*a*, 9*b*.

Further, in FIG. 1, there is also provided an image reading apparatus 10 which comprises an illumination lamp 10*a* for illuminating the imaged surface of the original G through a transparent glass 11 arranged in the original convey path, mirrors 10*b*, 10*c* and 10*d* for reflecting the illumination light, a lens 10*e* for condensing the reflected light, and an image reading element 10*f* such as a CCD. Further, a pair of discharge rollers 12 serve to discharge the original G the image of which was read onto a discharge tray 13. Incidentally, convey guides 14 for guiding the original G are disposed between the respective pairs of rollers.

Now, a relation between the lengths shown in FIG. 1 will be explained. A convey length $La_1$ between the registration means 8 and the second pair of convey rollers 6 has a relation ($La_1<Ls_1$) with respect to the length $Ls_1$ of the original G in the original conveying direction. Further, a convey length $La_2$ between the registration means 8 and the first pair of convey rollers 5 has a relation ($La_2<Ls_2$) with respect to the length $Ls_2$ of the original G in the original conveying direction.

Further, lengths obtained by adding a convey length Lb between the registration means 8 and the sensor 9 of light permeable type to the convey lengths $La_1$, $La_2$, respectively have relations $\{(La_1+Lb)>Ls_1\}$, $\{(La_2+Lb)>Ls_2\}$ with respect to the lengths $Ls_1$, $Ls_2$ of the original G in the original conveying direction, respectively.

Next, an operation of the original image reading apparatus having the above-mentioned construction will be explained.

When the originals G are set on the original stacking plate 1, the lengths $Ls_1$, $Ls_2$ of the originals G in the original conveying direction are detected by the sensors 2*a*, 2*b*. If the detected length of the original is $Ls_1$, since the length $Ls_1$ is greater than the convey length $La_1$ between the registration means 8 and the second pair of convey rollers 6 ($La_1<Ls_1$) and is smaller than the length ($La_1$+Lb) obtained by adding the convey length Lb between the registration means 8 and the sensor 9 of light permeable type to the convey length $La_1$ $\{(La_1+Lb)>Ls_1\}$, the second pair of convey rollers 6 previously separated from each other are abutted against each other. On the other hand, if the detected length of the original is $Ls_2$, since the length $Ls_2$ is greater than the convey length $La_1$ between the registration means 8 and the second pair of convey rollers 6 ($La_1<Ls_2$) and is also greater than the length ($La_1$+Lb) obtained by adding the convey length Lb between the registration means 8 and the sensor 9 of light permeable type to the convey length $La_1$ $\{(La_1+Lb)<Ls_2\}$, the second pair of convey rollers 6 is still maintained in the separated condition.

After the abutment/separation of the second pair of convey rollers 6 is effected, the pick-up roller 3 is rotated to feed out uppermost original(s) on the original stacking plate 1 toward the pair of separation rollers 4. If a single original is fed to the pair of separation rollers 4, the latter sends the original toward the first pair of convey rollers 5; whereas, if two or more originals are fed to the pair of separation rollers 4 at a time, the lower roller 4B of the pair of separation rollers 4 is rotated in a direction opposite to the original conveying direction, thereby separating the uppermost original alone from the other original(s), and the separated original is sent toward the first pair of convey rollers 5. However, since such a separation mechanism does not directly relate to the present invention, detailed explanation thereof will be omitted.

If the length of the original supplied in this way is $Ls_1$, since the second pair of convey rollers 6 are abutted against each other, the original is sent to the pairs of regist rollers 8*a*, 8*b* along the convey guides 14 by means of the first and second pairs of convey rollers 5, 6; whereas, if the length of the original is $Ls_2$, since the second pair of convey rollers 6 are separated from each other, the original is sent to the pairs of regist rollers 8*a*, 8*b* along the convey guides 14 by means of the first pair of convey rollers 5.

The pairs of regist rollers 8*a*, 8*b* are rotated at the same speed as the convey speeds of the pairs of convey rollers 5, 6. As shown in FIG. 3, the original pinched between the pairs of regist rollers 8*a*, 8*b* is conveyed toward the transparent glass 11 (forming a part of an image reading portion); meanwhile, the original passes through the sensors 9*a*, 9*b* of light permeable type. As soon as the original passes through the sensors 9*a*, 9*b*, signals are emitted from the respective sensor, and inclination of the tip end of the original is calculated on the basis of these signals by means of a calculation circuit (not shown). The rotations of the respective drive motors $M_1$, $M_2$ for the pairs of regist rollers 8*a*, 8*b* are controlled by the control means (not shown) on the basis of the calculated inclination, thereby correcting the skew-feed of the original G.

Figure 4:
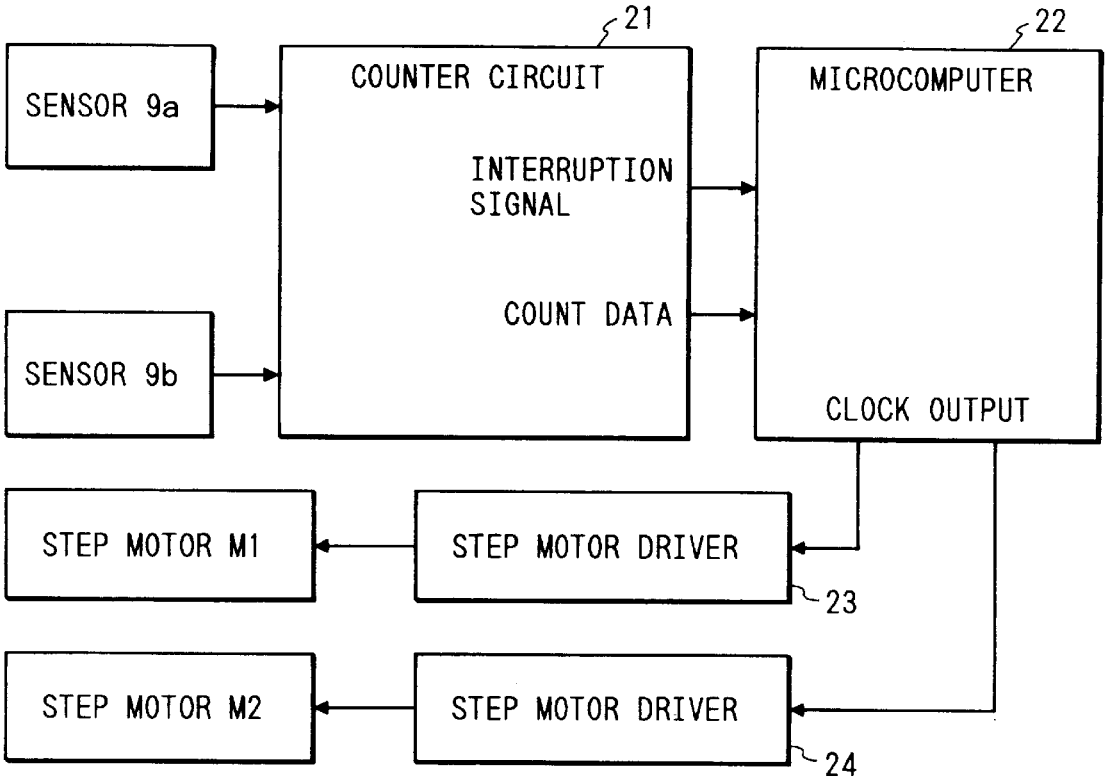
FIG. 4 is a control block diagram of the apparatus of FIG. 1.

Next, the skew-feed correction control will be explained with reference to a block diagram shown in FIG. 4 and a flow chart shown in FIG. 5. When the tip end of the original passes through the sensors 9*a*, 9*b* of light permeable type, due to a time difference between output timings of both sensors, count data corresponding to the skew amount is outputted from a counter circuit 21.

Figure 6:
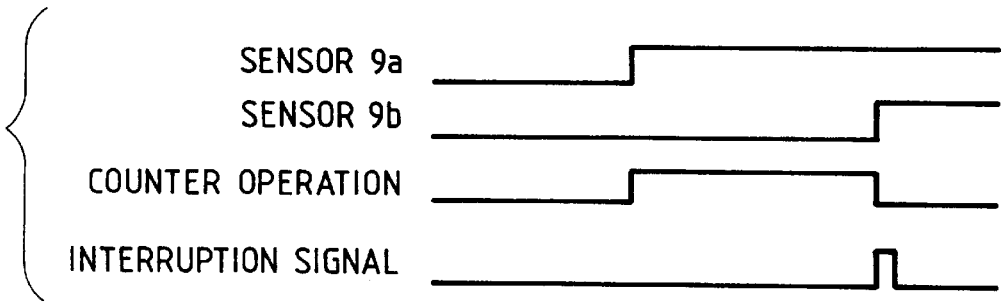
FIG. 6 is a control timing chart for the apparatus of FIG. 1.

In a timing chart shown in FIG. 6, the sensor 9*a* is turned ON before the sensor 9*b* is turned ON. The counter circuit 21 is started when the sensor output of the sensor 9*a* is changed to a high level, and a counting operation is continued until the sensor output of the sensor 9*b* is changed to a high level. If the sensor 9*b* is turned ON before the sensor 9*a* is turned ON, the counter circuit 21 is operated similarly.

Figure 5:
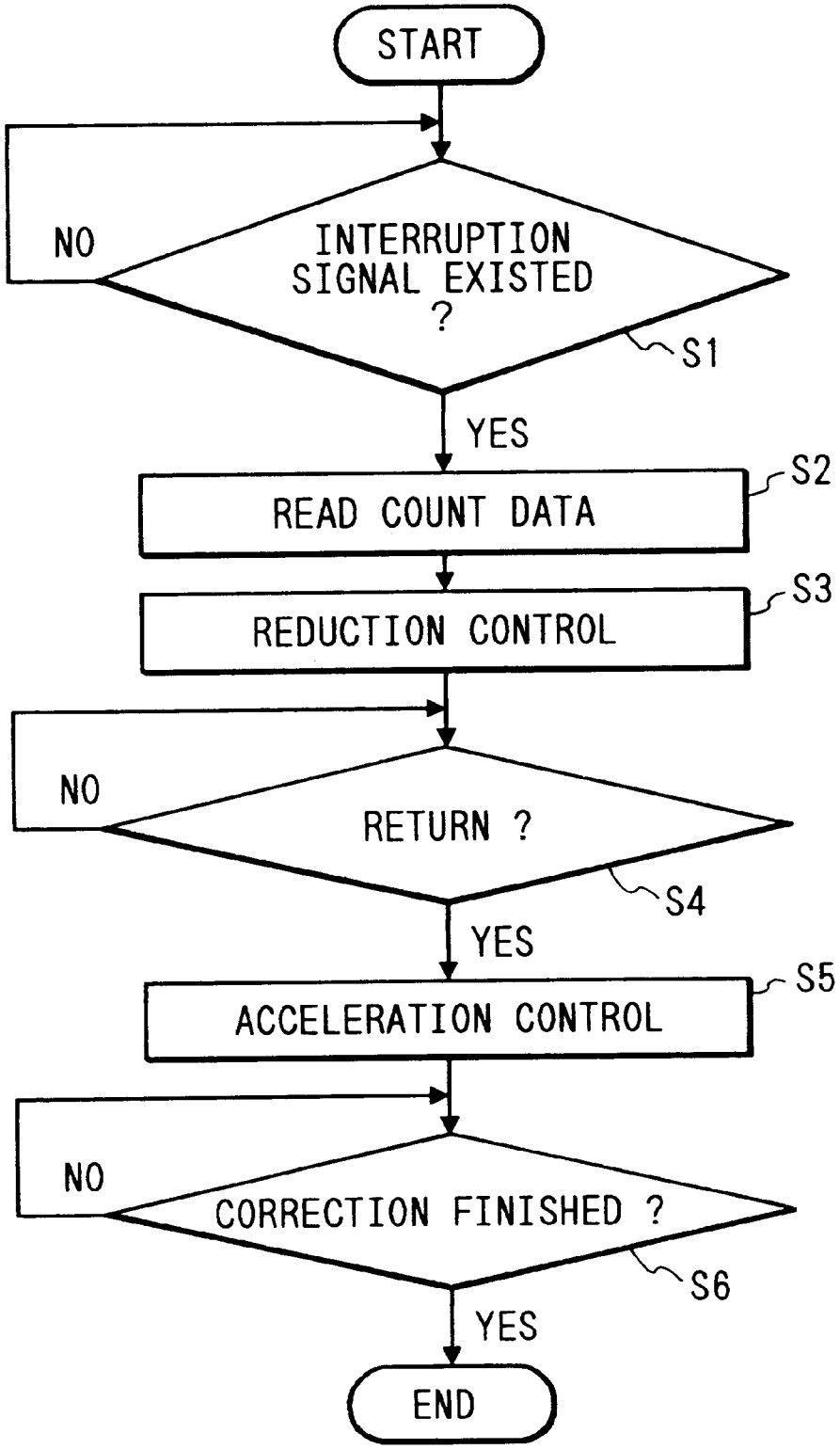
FIG. 5 is a control flow chart for the apparatus of FIG. 1.

Then, when both sensor outputs of the sensors 9*a*, 9*b* become the high levels, the counter circuit 21 emits an interruption signal which is in turn sent to a microcomputer 22 (step S1 in FIG. 5). When the interruption signal is inputted to the microcomputer 22, the latter reads in the count data, thereby determining the amount and direction of the skew-feed of the original (step S2). In the illustrated case, since the original passes through the sensor 9*a* prior to the sensor 9*b*, the microcomputer 22 controls reduction of motor $M_1$ for driving the regist rollers 8*a* nearer to a preceding corner 9*a* (among both corners 9*a*, 9*b*) of the tip end of the original G via step motor driver 23, thereby correcting the skew-feed of the original (step S3).

The reduction control will be fully described later with reference to a relation between drive frequency and control time shown in FIG. 7. The drive frequency is clocks outputted to the motor drive for the drive motor $M_1$. When the skew-feed correction control is not effected, the drive frequency normally has a value of 5000 Hz. When the reduction control (step S3) is started, the speed of the drive motor $M_1$ is gradually reduced. In the microcomputer 22, the difference in clock outputs outputted to the motors $M_1$, $M_2$ is counted by a counter circuit (not shown) provided in the microcomputer (step S4).

Figure 7:
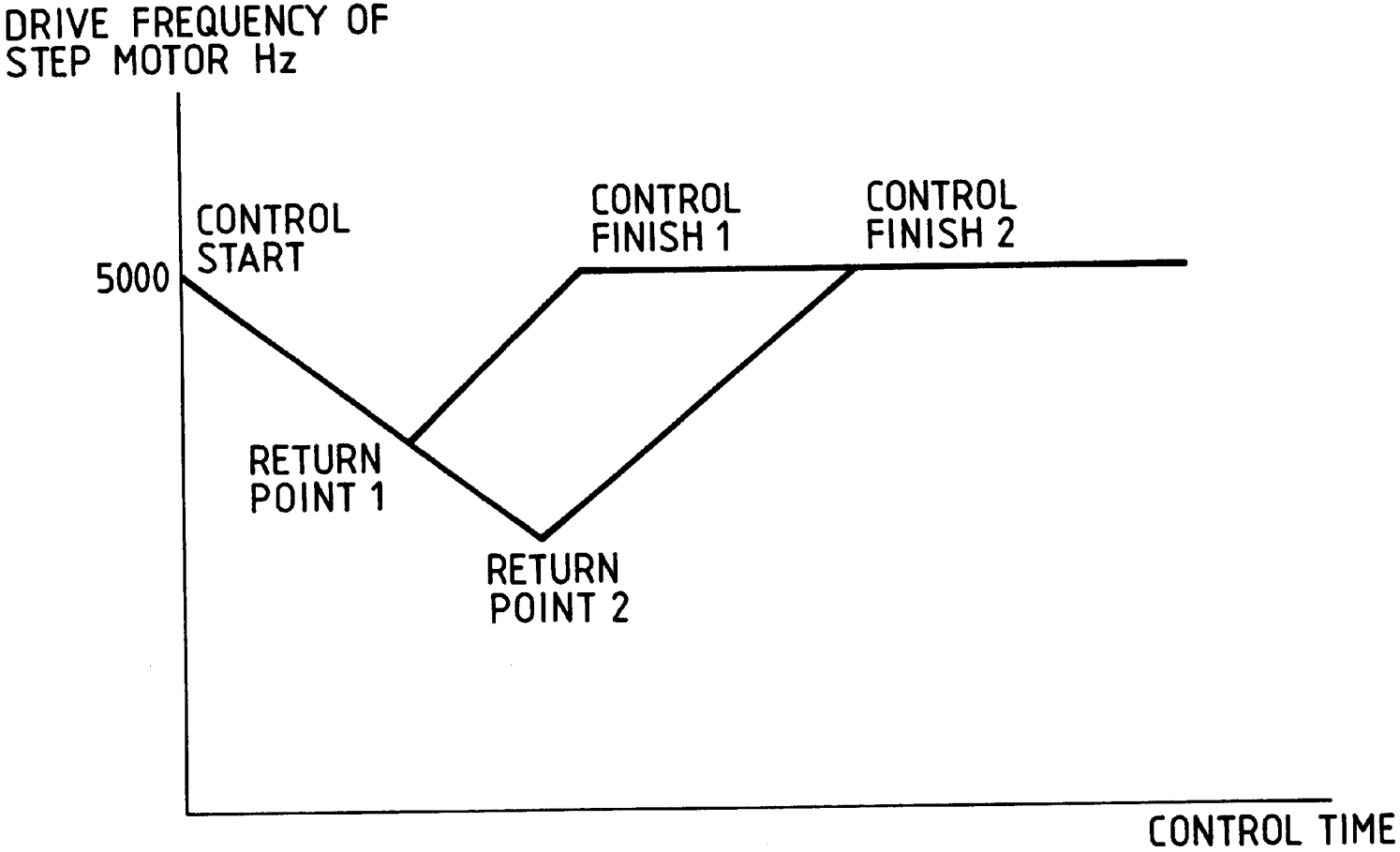
FIG. 7 is a graph showing the change in drive frequency of a step (pulse) motor in reduction control.

When the counted value becomes a half (½) of a count amount corresponding to the skew correction amount (i.e., when the correction of the half of the skew amount is finished), the acceleration control is started at a point corresponding to a return point 1 shown in FIG. 7 (step S5).

Similar to the reduction control, the difference in clock outputs outputted to the motors $M_1$, $M_2$ is counted by the counter circuit (not shown) provided in the microcomputer, and, when the counted value becomes equal to the count amount corresponding to the skew correction amount, the skew-feed correction is finished (corresponding to "control finish 1" in FIG. 7) (step S6). That is to say, a succeeding corner 9*b* is advanced more than the preceding corner 9*a* by an amount corresponding to the delayed distance.

If the skew amount is great, the time period for the reduction control is increased (corresponding to "return point 2" in FIG. 7) and the time period for the acceleration control is also increased accordingly (corresponding to "control finish 2" in FIG. 7). In this case, since the trailing end of the original G is greatly rotated, if the trailing end of the original is pinched between the pair of convey rollers 5 or 6, the rotational movement of the original will be limited.

However, in the illustrated embodiment, as mentioned above, when the tip end of the original reaches the sensors 9*a*, 9*b*, the trailing end of the original having the length of $Ls_1$ always leaves the pair of convey rollers 6, or the trailing end of the original having the length of $Ls_2$ leaves the pair of convey rollers 5 and the pair of convey rollers 6 are previously separated from each other. Accordingly, when the skew-feed of the original is corrected by the pairs of regist rollers 8*a*, 8*b*, the rotational movement of the trailing end of the original is not restrained. Thus, the skew-feed of the original can be corrected with high accuracy regardless of the length of the original.

Further, according to the illustrated embodiment, since the abutment or separation of the pair of convey rollers 6 can be selected by previously detecting the size of the original (or by inputting the size data by the operator), the timing control of the abutting and separating mechanism 7 for abutting or separating the pair of convey rollers 6 is not required to be accurately performed. Further, when the originals are continuously supplied, since the abutting or separating operation for the pair of convey rollers 6 is not performed every time, the service life of the abutting and separating mechanism 7 is not severely selected. Further, there is no bad influence upon the original reading due to any shock generated in the abutting or separating operation of the pair of convey rollers 6.

(Second Embodiment)

Figure 8:
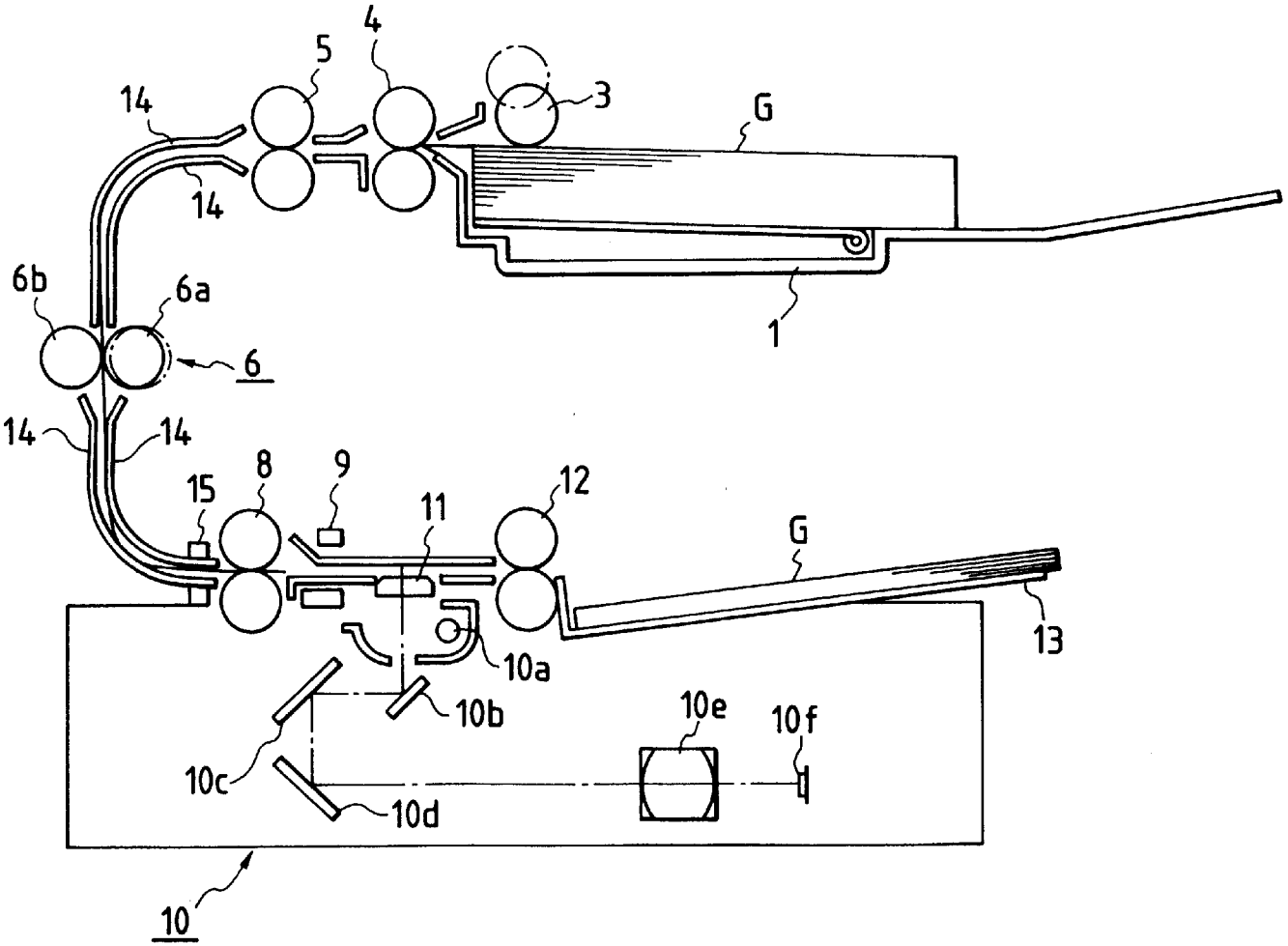
FIG. 8 is a schematic sectional view of a sheet conveying apparatus according to a second embodiment of the present invention applied to an original image reading apparatus.

Next, a sheet conveying apparatus according to a second embodiment of the present invention will be explained. Incidentally, also in this second embodiment, a sheet conveying apparatus is applied to an original image reading apparatus, and the same functional elements are designated by the same reference numerals and explanation thereof will be omitted. FIG. 8 is a schematic sectional view of an original conveying apparatus according to the second embodiment and an associated image reading apparatus.

In FIG. 8, a sensor (sheet end detection means) 15 for detecting a tip end of an original G is arranged in front of the registration means 8. In this embodiment, abutment and separation of a second pair of convey rollers 6 are effected by an abutting and separating mechanism 7 shown in FIG. 2B, and the second pair of convey rollers 6 are normally in a separated condition. The abutting and separating mechanism 7 shown in FIG. 2B comprises a motor 7*d* a rotation of which is controlled by a control means (not shown), a motor gear 7*e* supported by a shaft of the motor 7*d*, and a cam 7*f* having a partial toothed portion meshed with the motor gear 7*e*. The cam 7*f* is rotatably supported at its axis corresponding to a center of curvature of the toothed portion and has a lever portion adapted to be engaged by a shaft of the roller 6*a*.

In FIG. 8, the original G fed out by the pick-up roller 3 and separated by the pair of separation rollers 4 is sent to the registration means 8 by means of the pairs of convey rollers 5, 6. Meanwhile, the tip end of the original G is detected by the sensor 15 immediately before the tip end reaches the registration means 8. The pair of separable convey rollers 6 are separated from each other at a predetermined timing (i.e., within a time period from when the tip end of the original G is detected by the sensor 15 to when the tip end is pinched between the registration means 8). That is to say, in the abutting and separating mechanism 7 shown in FIG. 2B, when the motor 7*d* connected to the motor gear 7*e* is rotated in an anti-clockwise direction in FIG. 2 by a predetermined angle to rotate the cam 7*f* meshed with the motor gear 7*e* in an anti-clockwise direction, the lever portion of the cam 7*f* is engaged by the shaft of the roller 6*a* to shift the roller 6*a* away from the roller 6*b*, thereby separating the pair of convey rollers 6 from each other.

In the condition that the pair of convey rollers 6 are separated from each other, the original G is conveyed by the registration means 8 to pass through the sensor 9 (sheet skew amount detection means), where the skew amount of the original is detected. As is in the first embodiment, the rotations of the drive motors of the registration means 8 are controlled on the basis of the detected skew amount, thereby correcting the skew-feed of the original. In the skew-feed correcting operation, since the pair of convey rollers 6 are separated from each other, the trailing end of the original G is not restrained in the convey guides 14 regardless of the length of the original in the original conveying direction, so that the skew-feed of the original can be corrected by the registration means 8 with high accuracy.

According to the second embodiment, since the abutment and separation of the pair of convey rollers 6 are effected on the basis of the signal emitted from the sensor 15 arranged in front of the registration means 8, the skew-feed of the original can be corrected with high accuracy regardless of the length of the original in the original conveying direction.

Incidentally, in the second embodiment, while an example that the abutment and separation of the pair of convey rollers 6 are effected on the basis of the signal emitted from the sensor 15 arranged in front of the registration means 8 was explained, the present invention is not limited to this example. For example, the abutment and separation of the pair of convey rollers 6 may be effected on the basis of the signals emitted from the sensors 9 (sheet skew amount detection means). In this case, however, since the pair of convey rollers 6 must be separated from each other before the skew-feed correction is started, after the tip end of the original is detected by the sensor 9, there must be reserved a time period for separating the pair of convey rollers 6 from each other. Accordingly, this case is effective only when a distance between the registration means 8 and the image reading portion is long or when the original conveying speed is not so fast.

(Third Embodiment)

Figure 9:
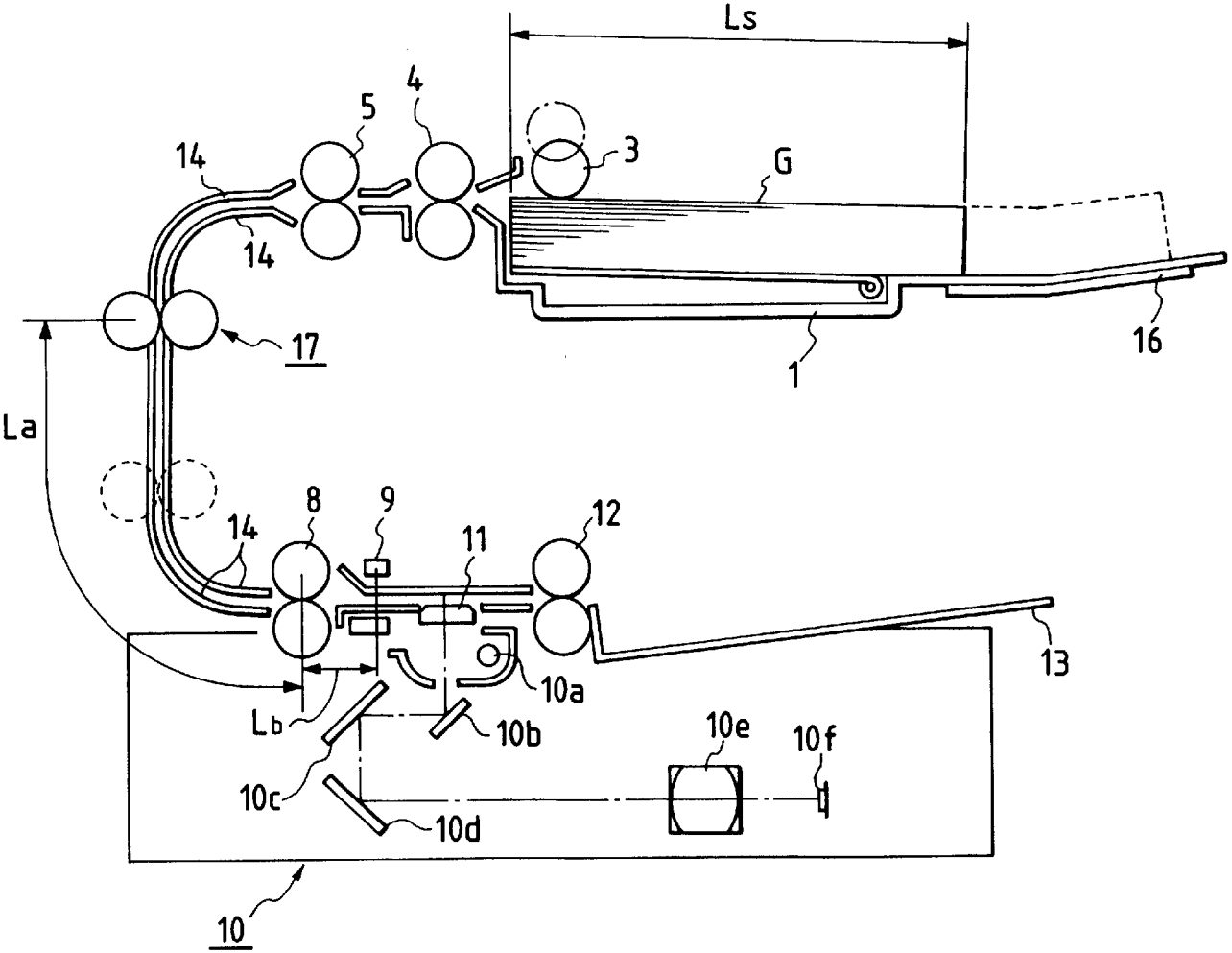
FIG. 9 is a schematic sectional view of a sheet conveying apparatus according to a third embodiment of the present invention applied to an original image reading apparatus.

Next, a sheet conveying apparatus according to a third embodiment of the present invention will be explained with reference to the accompanying drawings. Incidentally, in this third embodiment, a sheet conveying apparatus is applied to an original image reading apparatus, and the same functional elements are designated by the same reference numerals and explanation thereof will be omitted. FIG. 9 is a schematic sectional view of an original conveying apparatus according to the third embodiment and an associated image reading apparatus, and FIG. 10 is a perspective view showing a shifting mechanism for shifting a second pair of convey rollers.

In FIG. 9, a sensor array (sheet length detection means) 16 for detecting a length of an original G on the original stacking plate 1 is constituted by sensors of reflection type arranged side by side along the original conveying direction. A second pair of convey rollers 17 are designed so that they can be shifted in an up-and-down direction along the original convey path.

Figure 10:
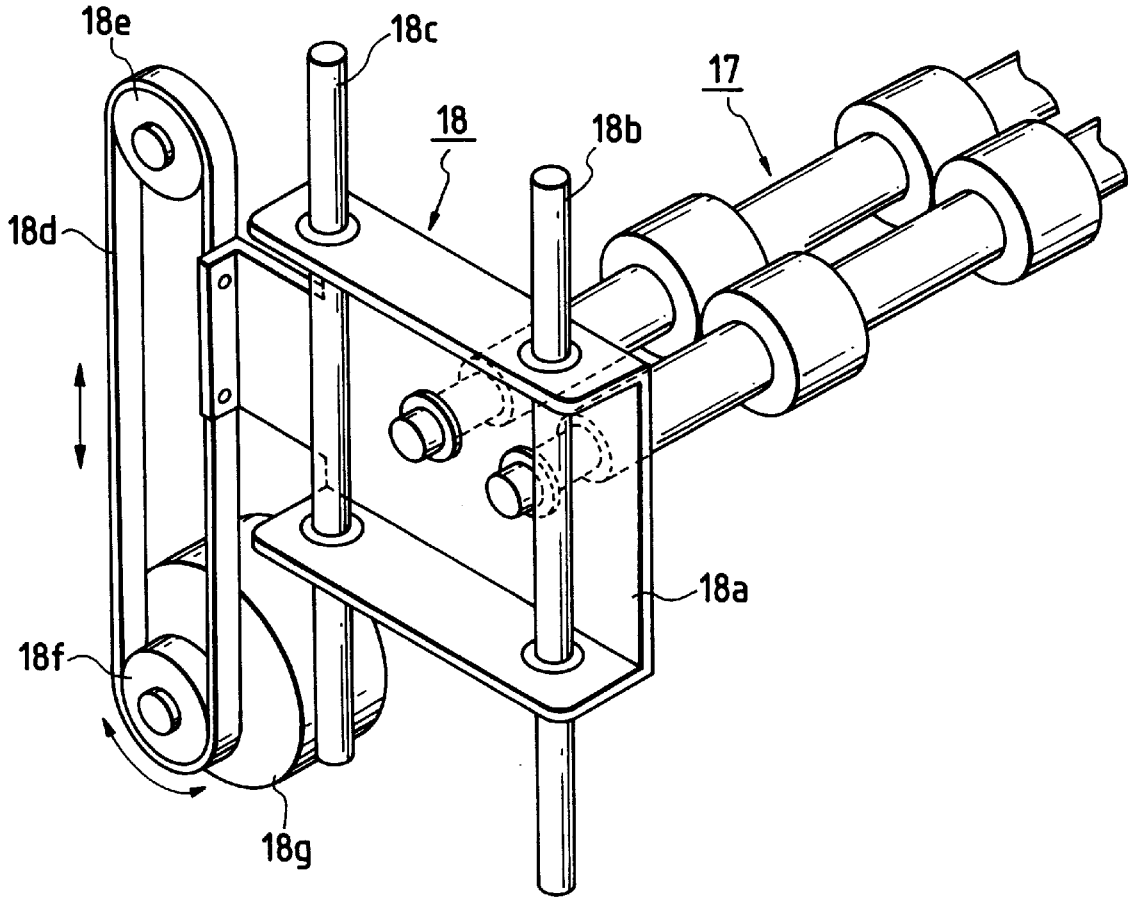
FIG. 10 is a perspective view of a shifting mechanism for shifting a pair of convey rollers of the apparatus of FIG. 9.

In FIG. 10, a shifting mechanism 18 for shifting the second pair of convey rollers 17 comprises a support plate 18*a* for rotatably supporting the paired rollers 17, guide rods 18*b*, 18*c* for guiding the support plate 18*a*, a timing belt 18*d* to which one end of the support plate 18*a* is secured, pulleys 18*e*, 18*f* around which the timing belt 18*d* is mounted, and a drive motor 18*g* connected to the pulley 18*f* and acting as a drive source for this pulley. The mechanism 18 is drivingly controlled by a control means (not shown).

In FIG. 9, the length (in the original conveying direction) of the original G rested on the original stacking plate 1 is detected by the sensor array 16. On the basis of a detection signal from the sensor array, the second pair of convey rollers 17 are shifted, by the shifting mechanism 18, to a position where a convey distance La between the second pair of convey rollers 17 and the registration means 8 becomes smaller than the length Ls of the original in the original conveying direction and a convey distance (La+Lb) between the second pair of convey rollers 17 and the sensor (skew amount detection means) 9 becomes greater than the length Ls of the original in the original conveying direction {La<Ls<(La+Lb)}. Accordingly, the original G is conveyed by the second pair of conveys rollers 17 until it is pinched between the registration means 8, and, when the tip end of the original reaches the sensor 9, the trailing end of the original leaves the second pair of convey rollers 17. Thus, when the skew-feed correction is effected, the original is pinched only by the registration means 8.

According to this embodiment, since the pair of convey rollers 17 can be shifted along the original convey path, even when the length of the original in the original conveying direction is changed, the skew-feed of the original can be corrected with high accuracy.

(The Other Embodiments)

In the first and third embodiments, while an example that the sensors of reflection type are arranged on the original stacking plate as the sheet length detection means for detecting the length in the original conveying direction) of the original rested on the original stacking plate was explained, the present invention is not limited to such an example. For example, the length of the original in the original conveying direction may be detected by a sheet length detection means 19 as shown in FIGS. 11A and 11B on the basis of movement of the original on the original stacking plate.

Figure 11A:
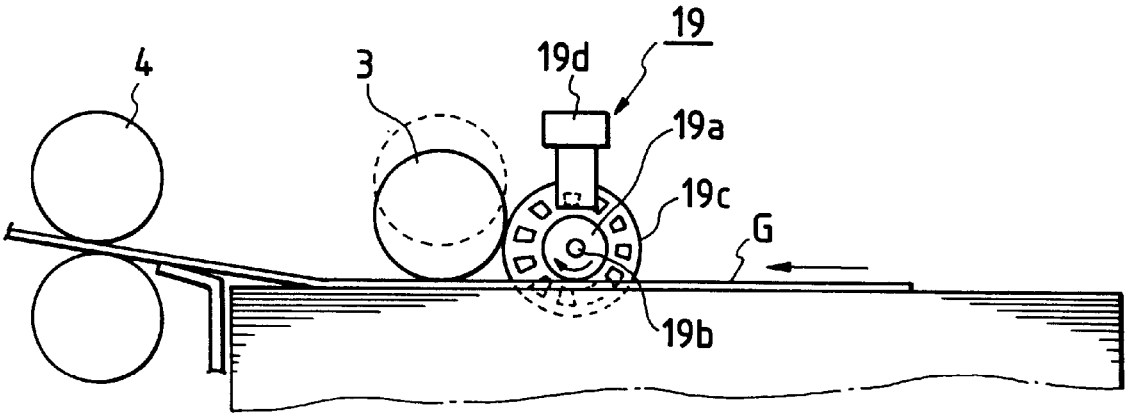
FIGS. 11A and 11B are constructional views showing a sheet length detection means.
Figure 11B:
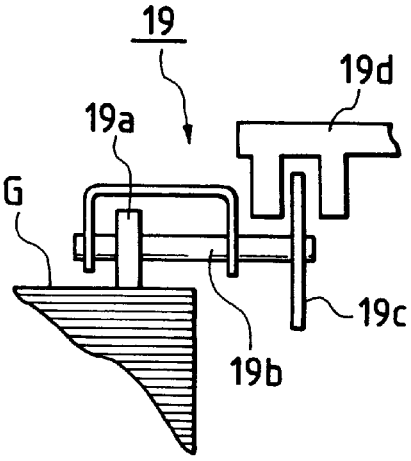

The sheet length detection means 19 shown in FIGS. 11A and 11B comprises a driven roller 19*a* having an outer surface coated by elastic material such as rubber having relatively high friction of coefficient and driven by movement of the uppermost original G, a circular timing disc 19*c* having a plurality of slits arranged along a circle coaxial with a shaft 19*b* of the driven roller 19*a*, and a photo-interrupter 19*d* of permeable type arranged to sandwitch one of slits of the timing disc 19*c*. Incidentally, in FIG. 11A, the reference numeral 3 denotes a pick-up roller, and 4 denotes a pair of separation rollers.

Figure 12:
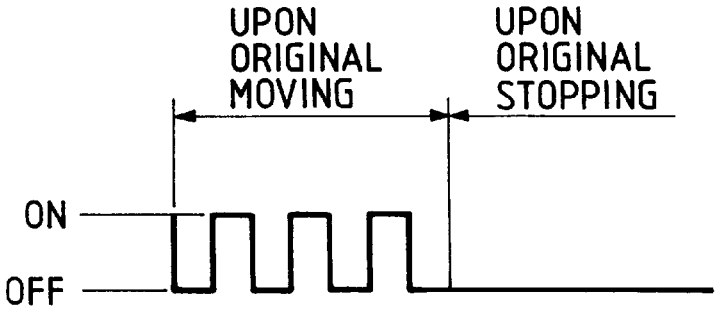
FIG. 12 is a timing chart showing a signal from the sheet length detection means.

In FIGS. 11A and 11B, the uppermost originals G are fed out by the pick-up roller 3 and are separated one by one by means of the pair of separation rollers 4. The separated original is further conveyed in the original conveying direction. When the uppermost original G is moved in this way, the driven roller 19*a* of the sheet length detection means 19 contacted with the uppermost original G is rotated in a direction shown by the arrow in FIG. 11A, thereby rotating the timing disc 19*c*. In this case, since the slits of the timing disc 19*c* are intermittently passed through between light emitting and light receiving portions of the photo-interrupter 19*d* to repeatedly prevent and permit the passage of light, ON/OFF signals as shown in FIG. 12 are regularly generated. The moving amount of the original is detected by the number of these signals. When the trailing end of the uppermost original passes through the roller 19*a*, since a next original is still stopped till a next original supplying operation, the roller 19*a* is not rotated, with the result that the photo-interrupter 19*d* continues to emit the ON signal or the OFF signal. Accordingly, the length of the original in the original conveying direction can be detected on the basis of a time period during which the signals are successively generated while the original is being shifted.

By using the sheet length detection means as mentioned above, since the length of each original which is being supplied can be detected, even when the originals rested on the original stacking plate have different lengths, the abutment or separation of the second pair of convey rollers or the shifting movement of the second pair of convey rollers can be effected correctly, thereby correcting the skew-feed of the original with high accuracy.

In the first embodiment, while an example that the second pair of convey rollers are normally in the separated condition was explained, the present invention is not limited to such an example. For example, the second pair of convey rollers may be normally in the abutted condition, and such rollers may be separated from each other on the basis of the detection signal regarding the length of the original in the original conveying direction. In this case, the same advantage as that of the first embodiment can be achieved. Further, this is true also in the second embodiment. Furthermore, in the aforementioned embodiments, while an example that only one pair of convey rollers among two pairs of convey rollers can be abutted against or separated from each other was explained, the present invention is not limited to such an example. For example, a plurality of pairs of convey rollers may be abutted against or separated from each other.

Further, in the aforementioned embodiments, while an example that the sheet conveying apparatus is applied to the original image reading apparatus was explained, the present invention is not limited to such an example. For example, it should be noted that the sheet conveying apparatus according to the present invention may be applied to any image forming apparatuses. In an example of the image forming apparatus, for example, in FIG. 1, recording materials such as copy sheets are stacked or rested on the original stacking plate (sheet stacking plate) in place of the originals G, and a recording system (including a recording head, a head driver circuit and the like) is provided in place of the optical system 10*a* to 10*f*, 11. In this case, if a copy sheet cassette is used, size information from the copy sheet cassette will be used as a means for determining a sheet length. Furthermore, by combining the original image reading apparatus and the image forming apparatus having the feature of the present invention, an image forming apparatus wherein image information read from the original is recorded on the copy sheet may be provided.

In the aforementioned embodiments, while an example that, when the output of the sensor 9*a* reaches the high level prior to the sensor 9*b*, the reduction control of the motor $M_1$ is effected to correct the skew-feed of the original was explained, the skew-feed of the original may be corrected by temporarily stopping the motor $M_1$. Alternatively, the skew-feed of the original may be corrected by effecting the acceleration control of the motor $M_2$. In addition, the reduction control of the motor $M_1$ and the acceleration control of the motor $M_2$ may be effected simultaneously. Further, in the aforementioned embodiments, while an example that the reduction control or acceleration control of the pulse motor is effected by changing the speed of the motor at a constant rate was explained, the present invention is not limited to such an example. For example, the speed of the motor may be changes steppingly from a normal speed $V_O$ to a higher speed $V_H$ or to a lower speed $V_L$. Further, in the aforementioned embodiments, while an example that the greater the skew amount of the original, the longer the time period of the reduction control to increase the difference in speed between two convey means was explained, the present invention is not limited to such an example. For example, the time period of the reduction control may be kept constant and, as the skew amount of the original is increased, the reduction rate may be increased or decreased.

Incidentally, the above-mentioned sheet conveying apparatuses can be applied to image forming apparatuses, as well as the original image reading apparatuses. Particularly, when the sheet conveying apparatus is arranged at an upstream side of an image forming means for forming an image on a sheet, the image can be formed on the sheet at a correct position.

Next, an embodiment wherein the registration of the sheet can be effected with high accuracy even after an apparatus was used for a long time or used repeatedly will be explained with reference to FIG. 13.

Figure 13:
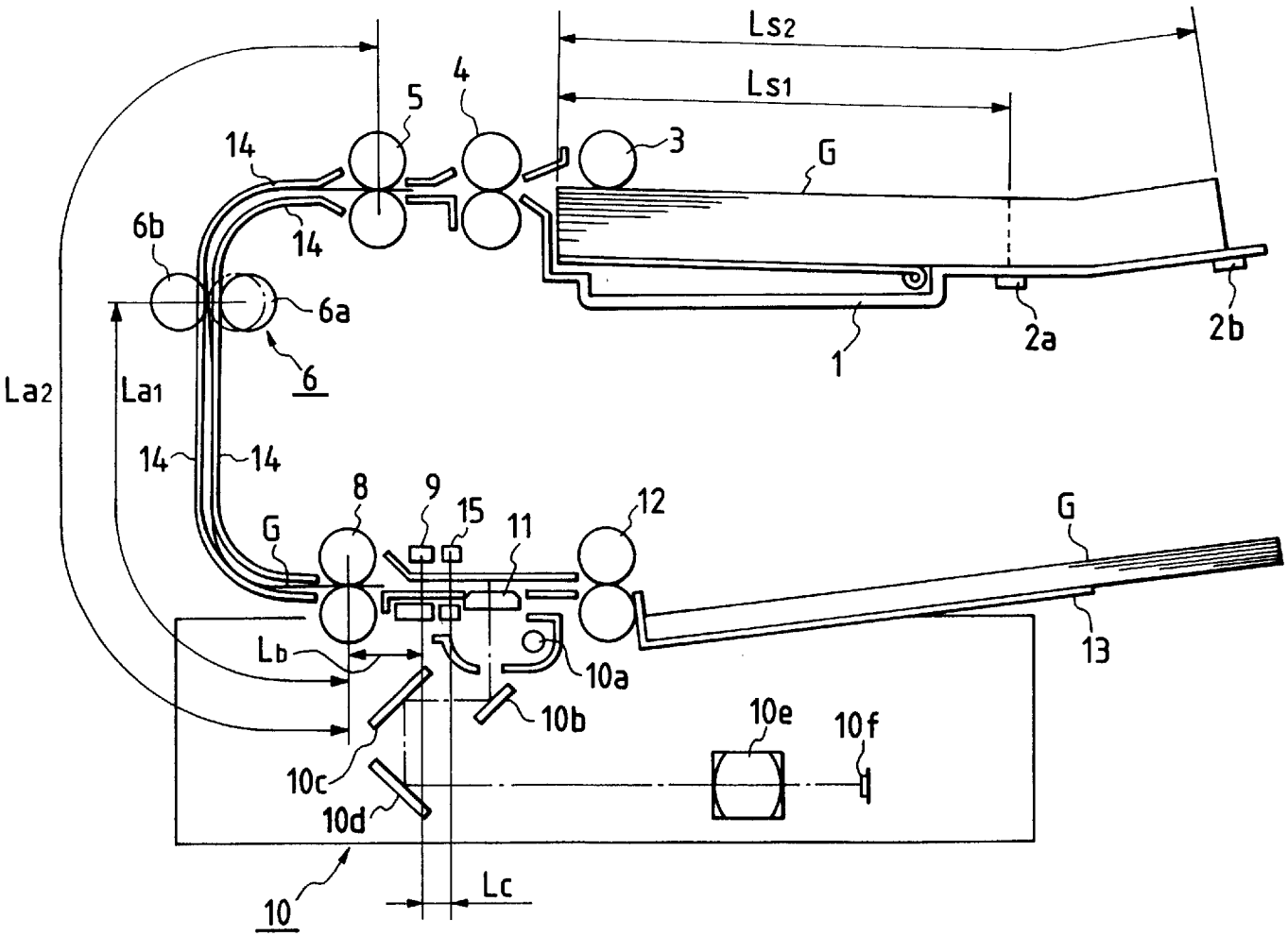
FIG. 13 is a schematic sectional view showing the other embodiment of the present invention.

In FIG. 13, additional two sets (15*a*, 15*b*) of sensors 15 of light permeable type are arranged between the sensor 9 of light permeable type for detecting the skew amount of the original and the image reading portion 11. When the skew-feed correction is finished before the tip end reaches the sensors 15, the result of the skew-feed correction can be ascertained by the sensor 15, and, thus, it is not required to measure the skew amount of the original again at the image reading portion 11. Normally, the measurement of the skew amount at the image reading portion requires the provision of counters arranged along a main scan direction (reading line direction). However, when the sensors 15 of light permeable type are added, the provision of the counters is not required.

By using such sensors 9, 15 of light permeable type, the skew-feed of the original can be effected permanently with high accuracy. Further, in this embodiment, when there are adequate time period and distance between the sensors 15 and the image reading portion 11, the fine correction of the skew-feed of the original can be effected between the sensors 15 and the image reading portion 11, if necessary, thereby completing the correction of the skew-feed more accurately.

Figure 14:
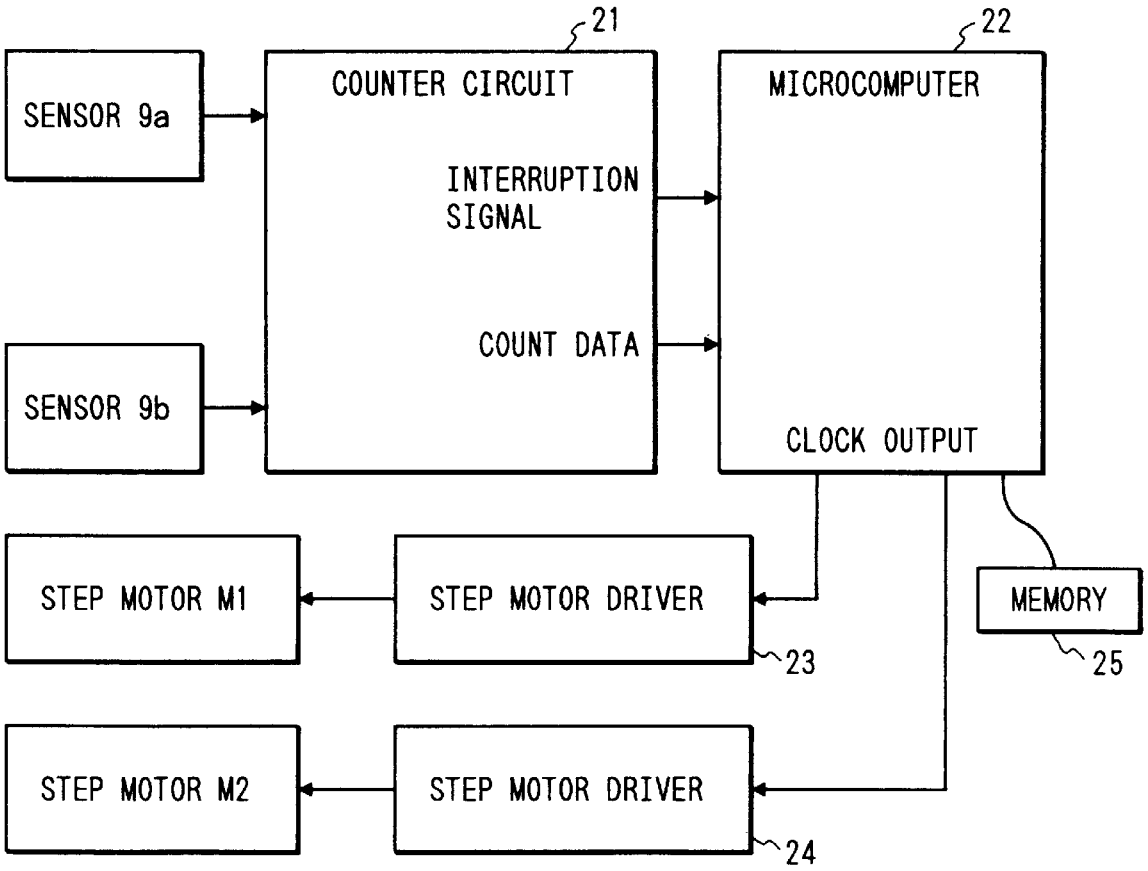
FIG. 14 is a control block diagram regarding the embodiment of FIG. 13.

However, since the pairs of regist rollers 8*a*, 8*b* are gradually worn to gradually decrease the friction force of each roller, the original convey speed of the regist rollers is also gradually decreased. As a result, the accuracy of the skew-feed correction (which was perfect initially) is also worsened gradually (but very slowly). In consideration of the above, the skew amount of the original is measured again at the image reading portion by counting a different in time between the output timings of the sensors 15*a*, 15*b*, and the measured amount is stored in a memory 25 (FIG. 14). After a certain number of originals (for example, several hundred thousands) were treated, if an average value of the skew amount (after skew-feed correction) regarding the latest ten thousand originals is not zero (0 mm) but is offset toward either the pair of regist rollers 8*a* or the pair of regist rollers 8*b* (for example, if the tip end corner of the original near the pair of regist rollers 8*a* advances by 0.1 mm more than the tip end corner of the original near the pair of regist rollers 8*b*), when the next correction is effected, the speed of the pair of regist rollers 8*a* is delayed by 0.1 mm in comparison with the pair of regist rollers 8*b*.

Figure 15:
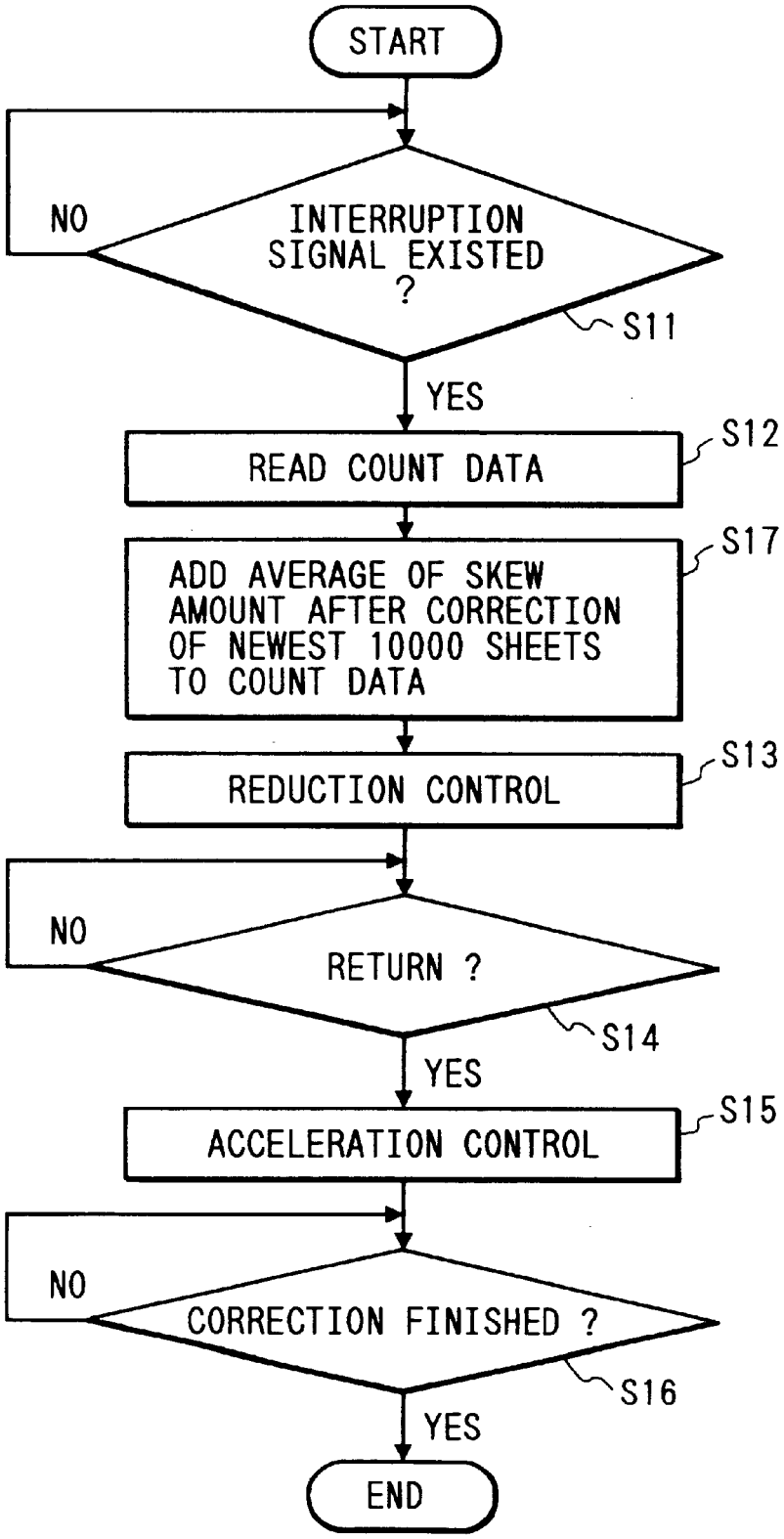
FIG. 15 is a control flow chart regarding the embodiment of FIG. 13.

Such correction control is shown in a flow chart of FIG. 15. A count data (skew amount) obtained by counting the difference in time between the output timings of the sensors 9*a*, 9*b* is read (step S12). Then, the average value of the skew amount (after skew-feed correction) regarding the latest ten thousand originals is added to the read count data (step S17), and then the reduction control is effected to perform the correction of the skew amount after addition (step S13). Then, after the treatments similar to the flow chart shown in FIG. 5 are completed (steps S14 to S16), the correction is ended.

Thereafter, the image reading operation may be started, or the skew-feed correction may be effected again on the basis of the skew amount (after skew-feed correction) calculated by the microcomputer 22 on the basis of the difference in time between the detection signals from the sensors 15*a*, 15*b*, before the image reading operations is started. Such skew-feed correction is effected on the basis of the flow chart shown in FIG. 5. In the step S12, the skew amount (after skew-feed correction) calculated on the basis of the outputs of the sensors 15*a*, 15*b* is read in.

By feedback-adjusting such correction amount on the basis of the latest corrected result, the control can be effected permanently with high accuracy. Further, even if the outer diameters of the regist rollers 8 are relatively greatly decreased due to the wear or other abnormity, since the self-feedback control can be performed, the frequency of exchange of the rollers by an expert service man can be greatly reduced.

As mentioned above, in the conveying apparatus wherein the skew-feed is corrected while conveying the sheet, since the abutment or separation, or the shifting movement of the paired rollers in the sheet convey means is controlled on the basis of the detection signal regarding the sheet length in the sheet conveying direction or the trailing end of the sheet and since, when the skew-feed of the sheet is corrected by using the registration means, the trailing end of the sheet in the sheet convey path is released from the paired rollers (without being pinched by said rollers), the sheets can be continuously conveyed with minimum sheet interval while correcting the skew-feed of the sheet with high accuracy. Further, by applying the sheet conveying apparatus to the image reading apparatus or the image forming apparatus, when the image reading apparatus or the image forming apparatus is operated at the same speed, the number of sheets to be treated per unit time can be increased, thereby improving the productivity.

Further, as mentioned above, in the conveying apparatus wherein the skew-feed is corrected while conveying the sheet, since after the skew-feed of the sheet was corrected by the registration means, the result of the skew-feed correction is measured and stored and the measured data can be fed-back, the correction accuracy can be maintained and improved permanently.

What is claimed is:

1. A sheet conveying apparatus comprising:

registration means for correcting a skew-feed of a sheet;

abuttable/separable sheet convey means arranged upstream of said registration means in a sheet conveying direction;

drive means for driving said convey means to abut/separate to and from the sheet;

sheet length detection means arranged upstream of said sheet convey means;

sheet skew amount detection means for detecting a sheet skew amount; and control means for controlling said drive means, wherein said sheet convey means is initially in the separated position, and is brought into the abutted position by control of said drive means by said control means when a length of the sheet detected by said sheet length detection means is longer than a convey length from said sheet convey means to said registration means and shorter than a convey length from said sheet convey means to said sheet skew amount detection means.

2. A sheet conveying apparatus comprising:

registration means for correcting a skew-feed of a sheet, said registration means arranged upstream of one of an image forming portion and an image for reading portion in a sheet conveying direction;

abuttable/separable sheet convey means arranged upstream of said registration means in the sheet conveying direction;

drive means for driving said convey means to abut/separate to and from the sheet;

sheet length detection means arranged upstream of said sheet convey means; and sheet skew amount detection means arranged downstream of said registration means in the sheet conveying direction; and control means for controlling said drive means, wherein said sheet convey means is initially in an abutted position, and is brought to the separated position by controlling said drive means by said control means when a length of the sheet detected by said sheet length detection means is longer than a convey length from said sheet convey means to said registration means and longer than a convey length from said sheet convey means to said sheet skew amount detection means.

3. A sheet conveying apparatus comprising:

registration means for correcting a skew-feed of a sheet, said registration means arranged upstream of one of an image forming portion and an image reading portion in a sheet conveying direction;

abuttable/separable sheet convey means arranged upstream of said registration means in the sheet conveying direction;

drive means for driving said convey means to abut/separate to and from the sheet;

sheet end detection means arranged upstream of said sheet convey means;

sheet skew amount detection means arranged downstream of said registration means in the sheet conveying direction; and control means for controlling said drive means, wherein said sheet convey means is initially in an abutted position, and is brought into the separated state by controlling said drive means by the control means corresponding to a timing when the sheet is nipped by said registration means based on a detected signal of the end of sheet by said sheet end detection means.

4. A sheet conveying apparatus comprising:

sheet skew detection means for detecting skew-feed of a sheet;

registration means for correcting a skew-feed of a sheet based on the skew detected by said sheet skew detection means;

sheet convey means disposed upstream of said registration means in the sheet conveying direction, said sheet convey means abuttable to and separable from the sheet;

a drive means for causing said convey means to abut/separate to and from the sheet;

a sheet length detect means for detecting a length of the sheet; and control means for controlling said drive means, wherein said sheet convey means is initially in a separated position and is brought into the abutted position by controlling said drive means by a control means when a length of the sheet detected by said sheet detection means is longer than length from said sheet convey means to said registration means and shorter than a convey length from said sheet convey means to said sheet skew amount detection means.

5. An image forming apparatus comprising a sheet conveying apparatus according to one of claims 1 to 4.

6. An image reading apparatus comprising a sheet conveying apparatus according to one of claims 1 to 4.

7. An image forming apparatus comprising an image reading apparatus according to claim 6.

8. A sheet conveying apparatus comprising:

a plurality of convey means for applying conveying forces to sheets simultaneously;

skew-feed detection means for detecting a skew-feed of the sheet;

control means for controlling a convey speed of at least one of said plurality of convey means so that the convey speeds of said plurality of convey means are different from each other, for correcting the skew-feed of a sheet based on the detection by said skew-feed detection means;

a pair of sheet convey rollers disposed upstream of said plurality of convey means in the sheet convey direction to be abutted/separated to and from each other;

drive means for causing said paired sheet convey rollers to abut/separate to and from each other; and sheet length detection means for detecting the length of sheet;

wherein said control means controls said drive means to abut said paired convey rollers to each other when the sheet length detected by said sheet length detection means is a first predetermined length, and to separate them when the sheet length is a second predetermined length so that said paired convey rollers do not restrain movement of the sheet upon correcting the skew-feed.

9. A sheet conveying apparatus according to claim 8, wherein said plurality of convey means include first and second convey means arranged side by side along a direction transverse to a sheet conveying direction.

10. A sheet conveying apparatus according to claim 9, wherein said control means controls in such a manner that a convey speed of said convey means nearer to a preceding tip end corner of the sheet advancing more than the other tip end corner is reduced in comparison with the other convey means, thereby correcting the skew-feed.

11. A sheet conveying apparatus according to claim 10, wherein said control means performs reduction control regarding a convey speed of said convey means nearer to a preceding tip end corner of the sheet advancing more than the other tip end corner, thereby correcting the skew-feed.

12. A sheet conveying apparatus according to claim 10, wherein said control means performs acceleration control regarding a convey speed of said convey means nearer to a succeeding tip end corner of the sheet delayed more than the other tip end corner, thereby correcting the skew-feed.

13. A sheet conveying apparatus according to claim 10, wherein said control means performs reduction control regarding a convey speed of said convey means nearer to a preceding tip end corner of the sheet advancing more than the other tip end corner and acceleration control regarding a convey speed of said convey means nearer to a succeeding tip end corner of the sheet delayed more than the other tip end corner, thereby correcting the skew-feed.

14. A sheet conveying apparatus according to one of claims 8 to 13, wherein each of said plurality of convey means comprises a rotary member contacted with the sheet, and a pulse motor for driving said rotary member.

15. A sheet conveying apparatus according to one of claims 8 to 13, wherein said skew-feed detection means comprises a plurality of sheet sensors for detecting presence/absence of the sheet arranged side by side along a direction transverse to a sheet conveying direction.

16. A sheet conveying apparatus according to claim 15, wherein said control means calculates a skew amount of the sheet on the basis of a difference between sheet detection times of said plurality of sheet sensors.

17. A sheet conveying apparatus according to claim 16, wherein said control means controls the convey speed of said convey means on the basis of the skew amount.

18. A sheet conveying apparatus according to claim 17, wherein said control means controls the convey speed of at least one of said plural convey means in such a manner that the greater the calculated skew amount the greater the difference in convey speed between said plural convey means.

19. A sheet conveying apparatus according to claim 17, wherein said control means controls the convey speed of at least one of said plural convey means in such a manner that the greater the calculated skew amount the longer a time period during when the convey speeds of said plural convey means are differentiated.

20. An image forming apparatus comprising an image forming means for forming an image of the sheet conveyed by a sheet conveying apparatus according to one of claims 8 to 13.

21. An image reading apparatus comprising an image reading means for reading an image of the sheet conveyed by a sheet conveying apparatus according to one of claims 8 to 13.

22. An image forming apparatus having an image reading apparatus according to claim 21.

* * * * *

UNITED STATES PATENT AND TRADEMARK OFFICE

CERTIFICATE OF CORRECTION

PATENT NO. : 5,918,876

DATED : July 6, 1999

INVENTOR(S): HIROYOSHI MARUYAMA, ET AL.

It is certified that error appears in the above-identified patent and that said Letters Patent is hereby corrected as shown below:

COVER PAGE AT ITEM [56] FOREIGN PATENT DOCUMENTS,
"0300095 5/1989 European Pat. Off.", "58-078937 5/1983 Japan", and "4-327445 3/1993 Japan." should be deleted eted.
COLUMN 9,
Line 28, "conveys" should read -convey-; and
Line 58, "sandwitch" should read -sandwich-.
COLUMN 11,
Line 10, "changes" should read -changed-.
COLUMN 12,
Line 24, "is" should read -are-.

Signed and Sealed this
Twenty-fifth Day of January, 2000

*Attest:*

*Attesting Officer*

*Acting Commissioner of Patents and Trademarks*